US009606486B2

(12) United States Patent
Arai et al.

(10) Patent No.: US 9,606,486 B2
(45) Date of Patent: Mar. 28, 2017

(54) ELASTIC ROLLER WITH NEEDLE-SHAPED FILLER AND FIXING DEVICE

(71) Applicant: CANON KABUSHIKI KAISHA, Tokyo (JP)

(72) Inventors: Yutaka Arai, Kawasaki (JP); Takeshi Suzuki, Yokohama (JP); Jun Miura, Kawasaki (JP); Shigeaki Takada, Abiko (JP); Toshinori Nakayama, Kashiwa (JP); Naoki Akiyama, Toride (JP); Daigo Matsuura, Tokyo (JP); Yasuhiro Miyahara, Tokyo (JP); Akeshi Asaka, Kashiwa (JP); Shuichi Tamura, Moriya (JP); Katsuhisa Matsunaka, Inagi (JP); Shinsuke Takahashi, Kashiwa (JP); Hiroto Sugimoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/798,230

(22) Filed: Jul. 13, 2015

(65) Prior Publication Data

US 2016/0018771 A1 Jan. 21, 2016

(30) Foreign Application Priority Data

Jul. 16, 2014 (JP) ..... 2014-145828
Jul. 17, 2014 (JP) ..... 2014-147000

(51) Int. Cl.
*G03G 15/20* (2006.01)

(52) U.S. Cl.
CPC ..... *G03G 15/206* (2013.01); *G03G 15/2089* (2013.01); *G03G 2215/2035* (2013.01)

(58) Field of Classification Search
CPC ..... G03G 15/8089; G03G 15/2089; G03G 15/206; G03G 15/2064
USPC ..... 399/333
See application file for complete search history.

(56) References Cited

U.S. PATENT DOCUMENTS

2010/0310290 A1* 12/2010 Sugawara ..... F16C 13/00 399/333
2012/0014726 A1* 1/2012 Sekihara ..... G03G 15/206 399/333
2012/0051810 A1* 3/2012 Yoshida ..... G03G 15/2057 399/333
2014/0301763 A1* 10/2014 Miura ..... G03G 15/2057 399/333

(Continued)

FOREIGN PATENT DOCUMENTS

JP 2012-37874 A 2/2012

*Primary Examiner* — Benjamin Schmitt
(74) *Attorney, Agent, or Firm* — Canon U.S.A. Inc., IP Division

(57) ABSTRACT

An elastic layer includes a needle-shaped filler and a void and has a porosity of 20 vol % or more and 60 vol % or less. The elastic layer contains a first area and a second area. The first area extends from a surface of the elastic layer opposite to a surface facing the mandrel toward the mandrel and has a thickness of 30% of the thickness of the elastic layer. The second area is a central area in a thickness direction of the elastic layer and has a thickness of 40% of the thickness of the elastic layer. The needle-shaped filler in the second area has an orientation degree of 50% or lower. The needle-shaped filler in the first area has an orientation degree higher than that of the needle-shaped filler in the second area.

18 Claims, 8 Drawing Sheets

(56) References Cited

U.S. PATENT DOCUMENTS

| | | | | |
|---|---|---|---|---|
| 2015/0160596 | A1* | 6/2015 | Asaka | G03G 15/206 399/333 |
| 2016/0018766 | A1* | 1/2016 | Akiyama | G03G 15/206 399/333 |
| 2016/0018772 | A1* | 1/2016 | Miura | G03G 15/2089 399/333 |

* cited by examiner

ELASTIC ROLLER WITH NEEDLE-SHAPED FILLER AND FIXING DEVICE

BACKGROUND OF THE INVENTION

Field of the Invention

The invention relates to a fixing device mounted on an image forming device such as an electrophotographic copying device or a printer, an elastic roller included in this fixing device, and the fixing device including the elastic roller.

Description of the Related Art

A fixing device included in an electrophotographic toner-image forming device includes a heating member, which is heated by a heater and heats an image by coming into contact with an image carrying surface of a recording medium, and a pressing member disposed opposite to the heating member and forming a fixing nip (hereinafter referred to as a "nip portion") in cooperation with the heating member.

In recent years, techniques for enhancing heating efficiency of a fixing device and reducing the start-up time (warm-up time) of a fixing device have been developed for energy saving. One example of such techniques is a use of porous silicone rubber having some voids as an elastic layer of a pressing member. Such a pressing member impedes thermal conduction. Thus, the pressing member prevents the heat from the heating member from transmitting through itself to other components, whereby the recording medium on which the toner is held can be efficiently heated at the nip portion.

The pressing member that impedes thermal conduction, however, has a disadvantage in that while a recording medium is passed through the nip portion, the pressing member accelerates temperature rise in an area of the pressing member with which a recording medium does not come into contact (hereinafter this area is referred to as a "non-sheet-passing area"), more specifically, in widthwise both end portions of the pressing member, that is, it accelerates "temperature rise in a non-sheet-passing area".

The temperature rise in a non-sheet-passing area is such a phenomenon that the temperature rises in an area of the nip portion with which a recording medium does not come into contact since the heat from the heating member is not transferred to the recording medium or toner on the recording medium. The temperature rise particularly occurs when recording media are successively passed through the nip portion. The temperature rise in a non-sheet-passing area may degrade the quality or distort the shape of the heating member or the pressing member of the fixing device. Moreover, when the nip portion that is in an excessively heated state after small-size recording media are passed therethrough receives a larger-sized recording medium, excessively molten toner may cause offset.

To address this situation, Japanese Patent Laid-Open No. 2012-37874 discloses a method for reducing the temperature rise in a non-sheet-passing area by enhancing the start-up performance with dispersion of voids in an elastic layer of the pressing roller and by enhancing the thermal transmission of the pressing roller in a direction along the rotation axis of the pressing roller (the direction is hereinafter referred to as an "axial direction") with orientation of a needle-shaped filler in the axial direction.

SUMMARY OF THE INVENTION

One aspect of the present invention is directed to providing an elastic roller that can keep its shape stable for a long period of time while preventing temperature rise in a non-sheet-passing area and maintaining quick start-up. Another aspect of the present invention is directed to providing a fixing device that can efficiently heat a recording medium while minimizing temperature rise in a non-sheet-passing area and that can stably form high-quality images.

According to a first aspect of the present invention, an elastic roller includes a mandrel and an elastic layer provided on the circumferential surface of the mandrel. The elastic layer contains a needle-shaped filler and a shell-less void and has a porosity of 20 vol % or more and 60 vol % or less. The elastic layer contains a first area and a second area. The first area extends from a surface of the elastic layer opposite to a surface facing the mandrel toward the mandrel and having a thickness of 30% of the thickness of the elastic layer. The second area is a central area in a thickness direction of the elastic layer and has a thickness of 40% of the thickness of the elastic layer. A needle-shaped filler in the second area has an orientation degree of 50% or lower, and a needle-shaped filler in the first area has an orientation degree higher than that of the needle-shaped filler in the second area.

According to a second aspect of the present invention, an elastic roller includes a mandrel and an elastic layer provided on the circumferential surface of the mandrel. The elastic layer contains a needle-shaped filler and a void and has a porosity of 20 vol % or more and 60 vol % or less. The elastic layer contains a first area and a second area. The first area extends from a surface of the elastic layer opposite to a surface facing the mandrel toward the mandrel and has a thickness of 30% of the thickness of the elastic layer. The second area is a central area in a thickness direction of the elastic layer and having a thickness of 40% of the thickness of the elastic layer. A needle-shaped filler in the second area has an orientation degree of 50% or lower, and a needle-shaped filler in the first area has an orientation degree of 55% or higher.

According to a third aspect of the present invention, a fixing device includes a heating member and a pressing member disposed opposite the heating member and pressed against the heating member. A recording medium is inserted into a nip portion between the heating member and the pressing member and tightly held at and transported through the nip portion so as to be heated. The pressing member is the elastic roller according to the first aspect.

Further features of the present invention will become apparent from the following description of exemplary embodiments with reference to the attached drawings.

DESCRIPTION OF THE EMBODIMENTS

Figure 1:
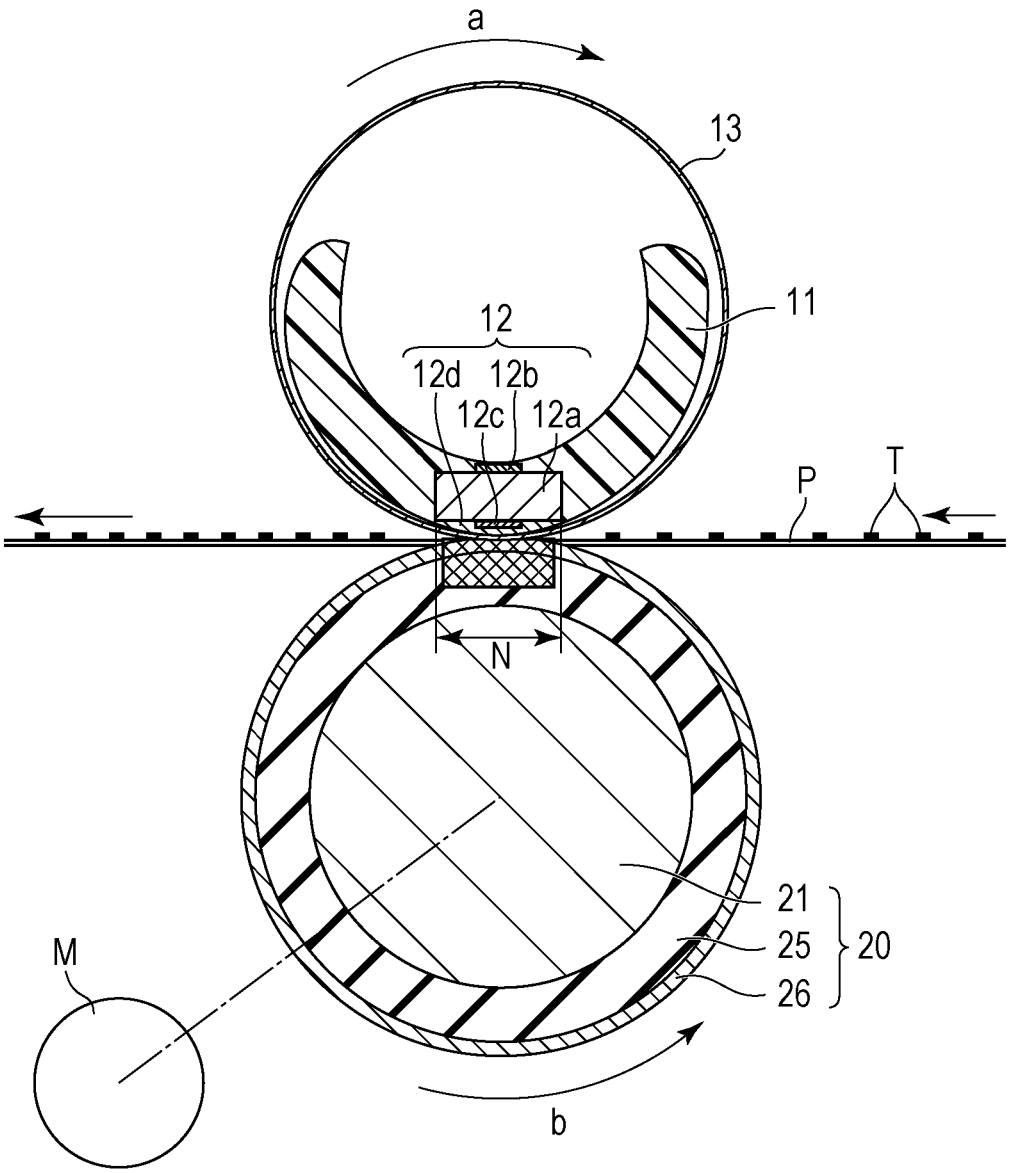
FIG. 1 is a cross-sectional view of an example of a fixing device according to an embodiment of the present invention.

To satisfy recent requirements for energy saving of an electrophotographic image forming apparatus, quicker start-up of the fixing device, that is, further reduction of warm-up time has been required.

The inventors have thus studied for further enhancement of the porosity in the elastic layer in the pressing roller described in Japanese Patent Laid-Open No. 2012-37874. The pressing roller described in Japanese Patent Laid-Open No. 2012-37874 includes an elastic layer formed by injecting, into a mold, a liquid composition containing an uncross-linked material of addition curable liquid silicone rubber, a needle-shaped filler, and a hollow body such as a microballoon or a resin balloon so that voids are dispersed while the needle-shaped filler has been oriented in a certain direction.

In the case where such a liquid composition containing a large number of hollow bodies is injected into a mold, however, the orientation of the needle-shaped filler in the axial direction is inhibited by the hollow bodies. Thus, the orientation of the needle-shaped filler in the axial direction and further enhancement of the porosity are incompatible with each other. On condition that the needle-shaped filler is oriented in the axial direction, the porosity exceeding 10% has been negligibly attained.

On the other hand, it has been found that the needle-shaped filler is allowed to be oriented in the direction along the rotation axis even in an elastic layer having a high porosity in the following case: where, instead of a liquid composition containing hollow bodies, a silicone rubber emulsion in which water and needle-shaped fillers are dispersed is injected into a mold, the silicone rubber is cured in the state of containing water, and then the water is removed from the cured silicone rubber.

In this method, after an emulsion containing an uncross-linked material of addition curable liquid silicone rubber, water, a thickener, a needle-shaped filler, and an emulsifier is injected into a mold, a silicone rubber component is cross-linked at a temperature at which water does not evaporate and then cured and dehydrated, so that porous silicone rubber is formed. In this method, water dispersed in the liquid silicone rubber is assumed to negligibly impede the orientation of the needle-shaped filler in the axial direction.

However, a pressing roller formed in such a method develops trouble after a long time use and becomes unable to form high-quality images due to, for example, unstable transportation of sheets (recording media) or creases on the pressing roller. Such trouble is probably caused by the following reasons. Unlike in the case where hollow bodies such as glass balloons are used, voids in the cured silicone rubber manufactured by the above-described method are not surrounded by shells. Thus, the elastic layer is easily deformed by the application of and release of the pressure during use as a pressing roller of the fixing device.

The inventors have diligently studied for providing an elastic roller that can keep its shape stable for a long period of time while preventing temperature rise in a non-sheet-passing area and maintaining quick start-up and consequently arrived at the present invention.

Embodiments of the invention are described in detail below.

(1) Fixing Device

FIG. 1 is a cross-sectional view of an example of a fixing device according to an embodiment of the present invention. This fixing device is a device of a film heating type. The schematic configuration of the fixing device is described below.

In FIG. 1, a film guide member 11 has a substantially semi-circular gutter-shaped cross section and is a wide film guide member having a width extending in a direction parallel to the longitudinal direction of the base. A heater 12 is a wide heater (heating unit constituting a heating member) housed and held in a groove formed at a substantially middle on the lower surface of the film guide member 11 so as to extend in the width direction. A film 13 is a film-shaped endless belt. The film 13 is shaped in a tube loosely wound around the film guide member 11 to which the heater 12 is attached.

The film guide member 11 is a molded product made of heat-resistant resin such as polyphenylene sulfide (PPS) or liquid crystalline polymer.

The heater 12 has such a configuration that a heat generating resistor is disposed on a ceramic substrate. The heater 12 illustrated in FIG. 1 includes a wide flat heater substrate 12*a* made of alumina and a linear or strip-shaped electrical heating element (heat generating resistor) 12*c* made of Ag/Pd extending in the longitudinal direction of the substrate on the surface of the heater substrate 12*a* (the surface over which the film slides). The heater 12 also includes a thin surface protection layer 12*d* made of glass for covering and protecting the electrical heating element 12*c*. A temperature-detection element 12*b* such as a thermistor is attached to the back surface of the heater substrate 12*a*. The heater 12 can be kept at a predetermined fixing temperature (target temperature) using a power controlling unit (not illustrated) including the temperature-detection element 12*b* after the temperature rises rapidly in response to power supply to the electrical heating element 12*c*.

The film 13 is, for example, a composition film obtained by coating the surface of the base film with a surface layer. In order that the film has a small heat capacity for quicker start-up of the fixing device, this film preferably has a total film thickness of 100 μm or smaller, more preferably, within the range of 20 μm to 60 μm.

Examples of the material of the base film include a resin material such as polyimide (PI), polyamide-imide (PAI), polyetheretherketone (PEEK), or polyether sulfone (PES) and a metal material such as SUS or Ni.

Examples of the material of the surface layer include fluoro-resin materials such as polytetrafluoroethylene (PTFE), tetrafluoroethylene-perfluoroalkylvinyl ether (PFA), and fluorinated ethylene propylene (FEP).

As appropriate, an elastic layer made of silicone rubber and/or a contact layer may be interposed between the base film and the surface layer.

A pressing roller 20 is an elastic roller disposed opposite the lower surface of the heater 12 with the film 13 interposed therebetween and pressed against the heater 12 to serve as a pressing member. Here, the heater 12 and the film 13 are components constituting a heating member. The heater 12 also functions as a unit for heating the film 13.

The pressing roller 20 is pressed with a predetermined pressing force by a predetermined pressing mechanism (not illustrated) against the surface protection layer 12*d* of the heater 12 with the film 13 interposed therebetween. An elastic layer 25 of the pressing roller 20 is elastically deformed in accordance with the pressing force, so that a nip portion N having a predetermined width required for heating and fixing an unfixed toner image is formed between the surface of the pressing roller 20 and the surface of the film 13.

A recording medium P is inserted into the nip portion N and tightly held at and transported through the nip portion N, so that the recording medium P is heated. The time for which the film 13 and the pressing roller 20 touch each other in the nip portion N is generally around 20 to 80 msec.

The pressing roller 20 is driven to rotate in the counter-clockwise direction in the direction of arrow b at a predetermined circumferential speed as a result of transmission of a driving force from a driving source M through a power transmission device (gear), not illustrated.

When the pressing roller 20 is driven to rotate counter-clockwise in the direction of arrow b during an image forming operation, the film 13 is driven by the rotation of the pressing roller 20 to rotate in the direction of arrow a.

(2) Elastic Roller

Figure 2A:
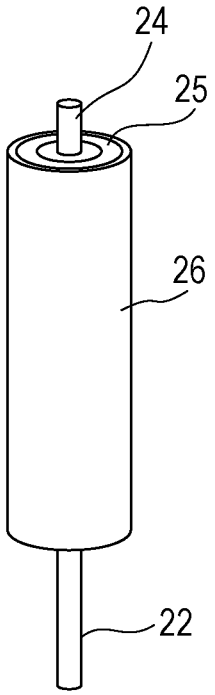
FIG. 2A is a schematic perspective view of an example of an elastic roller according to an embodiment of the present invention and FIG. 2B is a schematic cross-sectional view of the example of the elastic roller.

FIG. 2A is a perspective view of an example of an elastic roller according to an embodiment of the present invention. The elastic roller has such a configuration that the elastic layer 25 and a releasing layer 26 are stacked on the circumferential surface of a mandrel 21.

Subsequently, components of the elastic roller are described.

(2-1) Mandrel

Figure 2B:
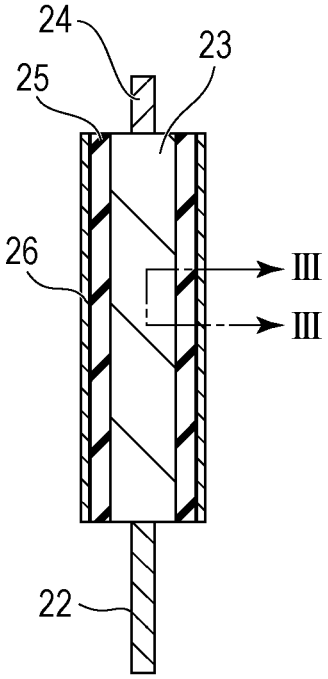

FIG. 2B is a cross-sectional view of the elastic roller illustrated in FIG. 2A, taken along the direction in which the mandrel 21 of the elastic roller extends.

As illustrated in FIG. 2B, a portion of the mandrel 21 around which the elastic layer 25 is disposed has a larger diameter than a portion of the mandrel 21 around which the elastic layer 25 is not disposed.

Figure 8:
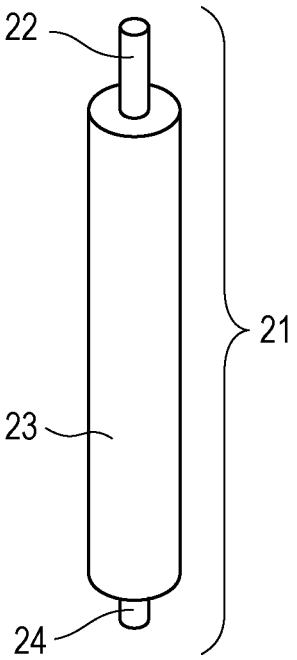
FIG. 8 is a schematic view of an example of a mandrel.

The configuration of the mandrel 21 is described in detail referring to FIG. 8. The mandrel 21 includes a driving rotation shaft 22, an elastic-layer receiving portion 23 around which the elastic layer 25 is formed, and an end rotation shaft 24. An example favorably usable as the mandrel 21 is a mandrel formed by performing surface processing, such as electroless nickel plating, on the surface of a polished free-cutting steel piece.

(2-2) Elastic Layer

Figure 3:
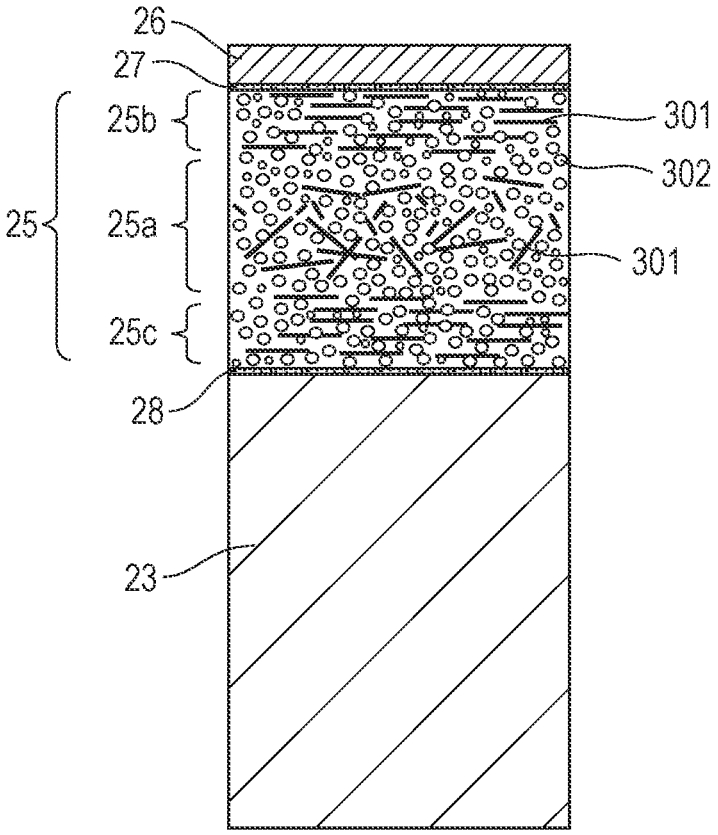
FIG. 3 is an enlarged view of a cross-sectional portion of an example of an elastic roller according to an embodiment of the invention taken along the line III-III in FIG. 2B.

The elastic layer is described in detail referring to FIG. 3. FIG. 3 is an enlarged view of a cross-sectional portion of the elastic roller taken along the line III-III in FIG. 2B.

As illustrated in FIG. 3, the elastic layer 25 is disposed on the circumferential surface of the elastic-layer receiving portion 23 of the mandrel 21 and the releasing layer 26 is disposed on the circumferential surface of the elastic layer 25. In FIG. 3, the elastic layer 25 is disposed on the elastic-layer receiving portion 23 with an adhesive layer 28 interposed therebetween and the releasing layer 26 is disposed on the elastic layer 25 with an adhesive layer 27 interposed therebetween.

The elastic layer 25 contains a needle-shaped filler 301 and a void 302.

The porosity of the elastic layer falls within the range of 20 vol % to 60 vol %.

An area extending from a surface of the elastic layer 25 opposite to the surface facing the mandrel 21 toward the mandrel 21 and having a thickness of 30% of the thickness of the elastic layer 25 is defined as a first area 25*b*. An area positioned at a center portion in the thickness direction of the elastic layer 25 and having a thickness of 40% of the thickness of the elastic layer 25 is defined as a second area 25*a*. Here, the orientation degree of the needle-shaped filler in the second area 25*a* is 50% or lower and the orientation degree of the needle-shaped filler in the first area 25*b* is higher than the orientation degree of the needle-shaped filler in the second area 25*a*.

The inventors have found the following facts from the study. In the case where the thickness of the elastic layer falls within the range of 2 mm to 5 mm, if recording media are successively passed through a nip portion formed by the heated fixing member and the pressing member disposed opposite the fixing member, the distance by which heat is transmitted from the heated fixing member to the elastic layer in the thickness direction of the elastic layer is within approximately 30% of the thickness of the elastic layer in a direction from the releasing layer-side surface of the elastic layer toward the mandrel.

In the elastic roller according to an embodiment of the invention, the orientation degree of the needle-shaped filler in the first area, which has a thickness corresponding to the depth of heat penetration, is higher than the orientation degree of a needle-shaped filler in the second area.

Thus, the use of an elastic roller as a pressing member allows the heat from the fixing member to effectively dissipate in the axial direction of the elastic roller. Accordingly, the heat in the non-sheet-passing area of the elastic roller is allowed to effectively dissipate, thereby preventing an excessive temperature rise in the non-sheet-passing area during successive sheet transportation.

The porosity of the elastic layer 25 falls within the range of 20 vol % to 60 vol %, and the heat conduction in the thickness direction of the elastic layer is suppressed. Thus, in the fixing device, heat conduction from the heating member to the pressing member can be suppressed. Further, the existence of voids reduces the apparent density of the elastic layer and thus can reduce the volumetric specific heat of the elastic layer. This configuration can suppress the heat of the heating member from being used for temperature rise of the pressing member. Consequently, this configuration shortens the warm-up time taken for the temperature at the nip portion to arrive at the temperature at which toner melts. Specifically, this configuration enables quicker start-up of the fixing device.

In addition, in the elastic layer, the orientation degree of the needle-shaped filler in the second area is 50% or lower. This configuration can suppress the deformation of the elastic layer 25 even after a long time use.

The elastic layer of the pressing member of the fixing device is repeatedly compressed with pressure at the nip portion and restored after passing through the nip portion due to the release of the pressure.

According to the study of the inventors, the following facts have been found. In the case where an elastic layer in which the orientation degree of the needle-shaped fillers is subjected to repetitive compression and restoration, the change in the thickness thereof is larger than that of the elastic layer in which the orientation degree of the needle-shaped filler is low. This is because the elastic layer in which the orientation degree of the needle-shaped filler is low exerts to a larger extent its reinforcing effect against the compressing force in the thickness direction of the elastic layer than the elastic layer in which the orientation degree of the needle-shaped filler is high.

At least a sheet passing area of the elastic roller can have such an orientation degree of the needle-shaped filler in the thickness direction. Specifically, in the sheet passing area of the elastic roller, the orientation degree of the needle-shaped filler in the second area can be 50% or lower and the orientation degree of the needle-shaped filler in the first area can be higher than the orientation degree of the needle-shaped filler in the second area.

Figure 9A:
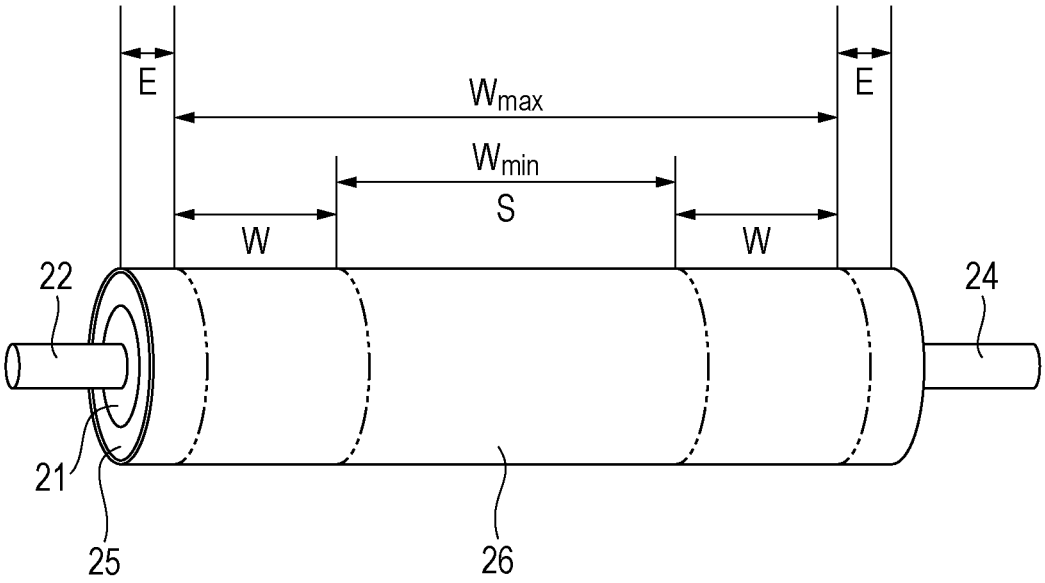
FIGS. 9A and 9B illustrate non-sheet-passing areas of an elastic roller.
Figure 9B:
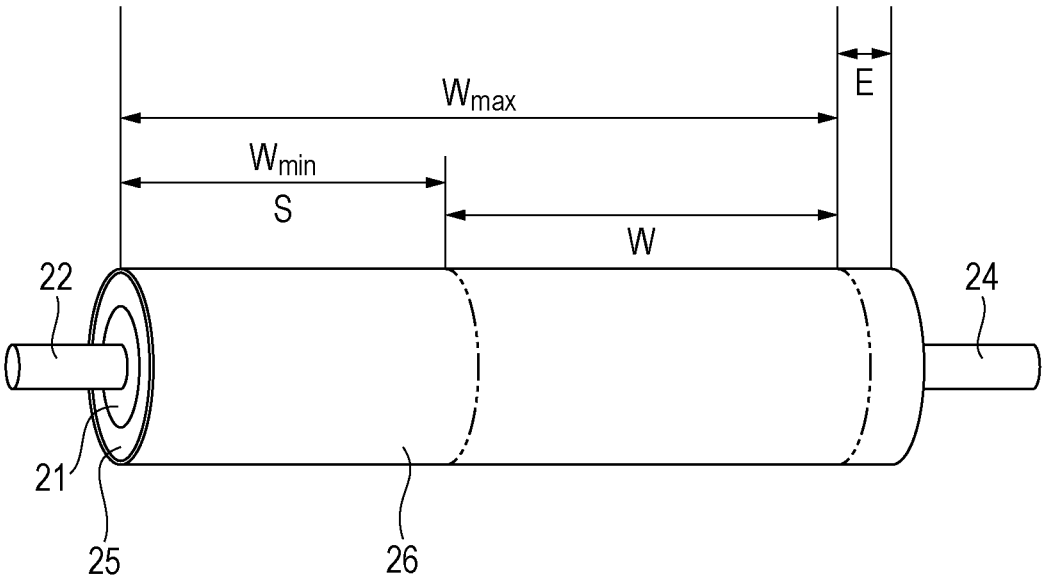

Here, the sheet passing area of the elastic roller is an area in the longitudinal direction of the elastic roller with which recording media do not come into contact while passing through the nip portion. FIGS. 9A and 9B illustrate the sheet passing areas of the elastic roller. FIG. 9A illustrates the sheet passing area of the elastic roller when different-sized sheets are passed through while having their middle lines aligned with the middle line of the elastic roller. FIG. 9B illustrates the sheet passing area of the elastic roller when different-sized sheets are passed while having their ends aligned with the end of the elastic roller. $W_{max}$ denotes the width of the sheet maximum insertable into the nip portion N and $W_{min}$ denotes the width of the sheet minimum insertable into the nip portion N. In this embodiment, the width $W_{max}$ of a maximum sheet is the width (short side) of an A3 sheet, which is 297 mm, and the width $W_{min}$ of a minimum sheet is the width (short side) of an A5 sheet, which is 148 mm. The portion of the elastic roller located within the width $W_{min}$ in the longitudinal direction is a portion of the elastic roller over which sheets having any size pass and this portion is referred to as a sheet passing area S. The portions of the elastic roller located within the width $W_{max}$ but beyond the width $W_{min}$ in the longitudinal direction are referred to as sheet passing areas W. The portions of the elastic roller located beyond the width $W_{max}$ are referred to as non-sheet-passing areas E. The sheet passing area in the embodiment of the invention includes the sheet passing areas W and the sheet passing area S.

The elastic layer according to an embodiment of the invention can be a silicone rubber layer. In addition, this silicone rubber layer may be a sole silicone rubber layer in the elastic roller.

The thickness of the elastic layer is not limited to a particular thickness but generally falls within the range of 2 mm to 5 mm.

(2-2-1) Orientation Degree of Needle-Shaped Filler

In the elastic layer 25, the orientation degree of the needle-shaped filler in the second area is 50% or lower. The orientation degree of the needle-shaped filler in the first area is higher than the orientation degree of the needle-shaped filler in the second area.

The orientation degree of the needle-shaped filler in the second area is preferably within the range of 30% to 50%. The orientation degree of the needle-shaped filler in the first area is preferably 55% or higher, more preferably, within the range of 55% to 70%.

Referring to FIGS. 4A, 4B, 4C, and 4D, the definition of the orientation degree is described.

Figure 4A:
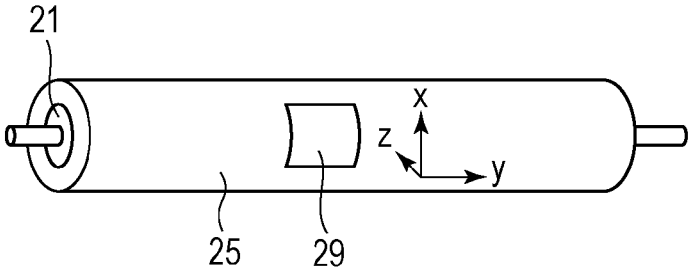
FIGS. 4A, 4B, 4C, and 4D illustrate the definition of the orientation degree.
Figure 4B:
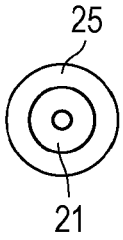
Figure 4C:
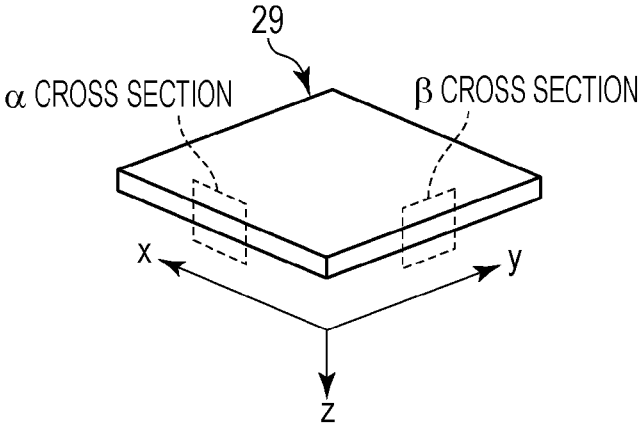

Firstly, as illustrated in FIG. 4A, a sample 29 of the elastic layer 25 is cut out from the elastic roller using a razor. Here, the sample 29 has a dimension of 10.0 mm in the x-axis direction, a dimension of 10.0 mm in the y-axis direction, and the full thickness of the elastic layer 25 in the z-axis direction. FIG. 4C is an enlarged perspective view of the cut-out sample 29.

Figure 4D:
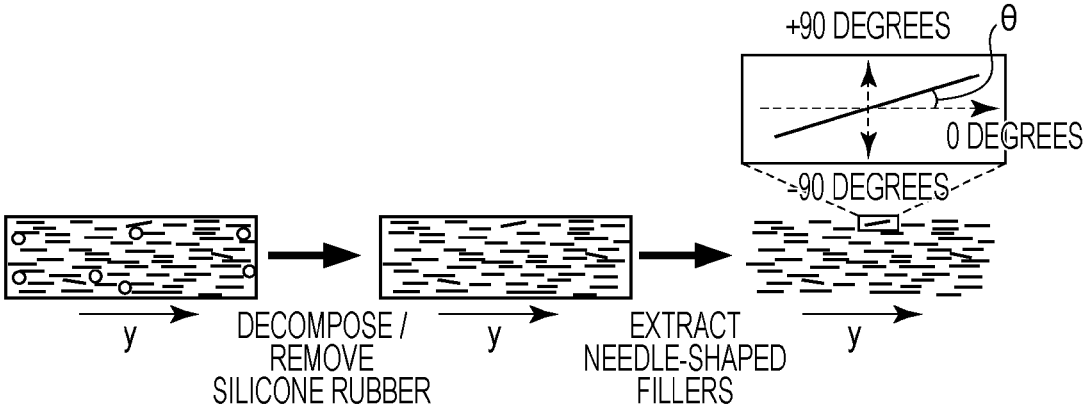

FIG. 4D illustrates the procedure for measuring the orientation degree of a needle-shaped filler in the sample 29.

The sample 29 is heated at 1000° C. for one hour under the nitrogen gas atmosphere using a thermogravimetric apparatus (trade name of TGA851e/SDTA, manufactured by Mettler Toledo International Inc.) to decompose/remove silicone rubber.

When the sample is fired in this manner, the releasing layer, even if disposed on the surface, is also removed together with silicone rubber. Then, only the needle-shaped filler is left in the sample 29 from which silicone rubber is removed, while their orientation states remain unchanged as they are from the time when silicone rubber exists. Then, a "β cross-section", illustrated in FIG. 4C, of the sample 29 from which silicone rubber is removed is observed at five points each in portions corresponding to the second area and the first area of the elastic layer 25. The observation involves the use of a confocal microscope (trade name of OPTELICS C130, manufactured by Lasertec Corporation).

From the observation images of the "β cross-section", the angles of the needle-shaped fillers are measured. A needle-shaped filler extending across the second area and the first area is excluded from the observation.

In the observation images of the "β cross-section" of the sample 29, the needle-shaped fillers staying in the area down to approximately 50 μm from the observation surface in the depth direction can be observed. Specifically, in the observation images of the "β cross-section", the needle-shaped fillers located in the area down to approximately 50 μm from the "β cross-section" in the x-axis direction can be observed.

Here, the angle θ of each needle-shaped filler was calculated with respect to the longitudinal direction of the elastic layer 25 (y direction in FIG. 4D), at which the angle θ is zero degrees. As the angle θ of a needle-shaped filler is closer to zero degrees, the needle-shaped filler is oriented closer to the longitudinal direction of the elastic layer 25.

From the observation images of the "β cross-section", the percentage of the needle-shaped fillers having angles θ within ±5 degrees [(number of needle-shaped fillers having angles θ within ±5 degrees/total observable needle-shaped fillers)×100%] was calculated. The average of percentages at any five measured points was defined as an orientation degree.

(2-2-2) Void

The porosity of the elastic layer 25 falls within the range of 20 vol % to 60 vol %. The elastic layer 25 having porosity not lower than 20 vol % is fully effective in reduction of the above-described start-up time. The elastic layer 25 having porosity not higher than 60 vol % facilitates molding of an elastic layer in which the orientation of the needle-shaped filler is controlled. The start-up time can be further reduced with increasing porosity. Thus, more preferably, the porosity falls within the range of 40 vol % to 60 vol %.

The porosity of the elastic layer 25 can be obtained in the following manner.

Firstly, any portion of the elastic layer 25 is cut using a razor. The volume of the cut-out portion under the temperature of 25° C. is measured with an immersion relative-density measuring device (SGM-6, manufactured by Mettler Toledo International Inc.) and this volume is referred to as Vall. Subsequently, an evaluation sample subjected to volume measurement is heated at 700° C. for one hour under the nitrogen gas atmosphere using a thermogravimetric apparatus (trade name of TGA851e/SDTA, manufactured by Mettler Toledo International Inc.) so as to decompose/remove the silicone rubber component. The degree of weight by which the weight is reduced at this time is denoted by Mp. In the case where the elastic layer 25 contains inorganic fillers besides the needle-shaped filler, the remnants left after the decomposition/removal are a mixture of the needle-shaped filler and the inorganic fillers.

In this state, the volume of the cut-out portion under the temperature of 25° C. is measured using an automatic dry density meter (trade name of ACCUPYC 1330-1, manufactured by Shimadzu Corporation) and this volume is denoted by Va. Based on these values, the porosity can be calculated by the following formula (1), where the density of the silicone rubber component was assumed to be 0.97 g/cm$^3$ (this density is denoted by ρp):

$$\text{porosity (vol \%)}=[\{(Vall-(Mp/\rho p+Va)\}/Vall]\times 100 \qquad \text{Formula (1).}$$

(2-3) Releasing Layer

The releasing layer 26 is disposed on the outer surface of the elastic layer 25.

An example favorably used as the releasing layer is a fluororesin material such as PFA that allows recording media to be easily separated from the releasing layer. The thickness of the releasing layer varies depending on the product specification and is typically within the range of 30 μm to 50 μm.

(3) Method for Manufacturing Elastic Roller

The elastic roller can be formed in the following manner. An uncrosslinked material of silicone rubber, water, a thickener, a needle-shaped filler, and an emulsifier are mixed and stirred to prepare an emulsion. The emulsion is injected into a mold for cast molding and left to cure, whereby a base polymer in which water is uniformly and finely dispersed is formed. Thereafter, water in the base polymer is caused to evaporate, so that the elastic roller is formed.

(3-1) Emulsion (3-1-1) Uncrosslinked Material of Silicone Rubber

The uncrosslinked material of silicone rubber may contain polydiorganosiloxane (referred to as a "raw rubber A", below) that contains at least two alkenyl groups in each molecule, polyorganosiloxane (referred to as a "raw rubber B", below) that contains at least two silicon atom-bonded hydrogen atoms in each molecule, and a hydrosilylation catalyst. The raw rubber A and the raw rubber B are normally prepared as separate materials. For example, an A liquid containing the raw rubber A and a B liquid containing the raw rubber B are separately prepared.

Here, the raw rubber A is alkenyl-containing polydiorganosiloxane obtained by mixing the following raw rubber A1 and raw rubber A2:

the raw rubber A1 is polydiorganosiloxane that has alkenyl groups on both molecular chain terminals and that does not contain alkenyl groups in the side chains on the molecular chain, and the raw rubber A2 is polydiorganosiloxane that has at least two alkenyl groups in the side chains on the molecular chain.

The raw rubber B is polyorganosiloxane that has at least two silicon-bonded hydrogen atoms in each molecule.

(3-1-2) Water and Thickener

Any type of pure water is usable, but typically, deionized water is used. Since water has a lower viscosity than the A liquid and the B liquid, the use of a thickener is favorable for facilitating mixture and dispersion of water so that water can be used in the form of a C liquid containing a thickener. Examples of the thickener include various types including inorganic and organic thickeners, but inorganic thickeners are favorably used. Among inorganic thickeners, use of an inorganic thickener (BEN-GEL W-200U, manufactured by HOJUN Co., Ltd.) formed from organic-polymer-composite hydrophilic purified bentonite containing smectite-group clay mineral is favorable because it facilitates adjustment of the viscosity of the C liquid.

The emulsion used for forming the elastic layer does not contain empty particles having shells, which have been used thus far for forming voids. This configuration negligibly impedes the orientation of the needle-shaped filler in the direction in which the emulsion flows.

(3-1-3) Needle-Shaped Filler

Examples usable as the needle-shaped filler are those having a fiber shape having a large ratio of the length L to the diameter D (hereinafter this ratio is referred to as an "aspect ratio"). Each needle-shaped filler may have either a circular or angular bottom surface. Any material is usable for the needle-shaped filler as long as it is oriented in the direction along the rotation axis of the elastic roller by a molding method. A needle-shaped filler that has a thermal conductivity within the range of 500 W/(m·K) to 900 W/(m·K) is favorable since such needle-shaped fillers can more effectively prevent the temperature rise in a non-sheet-passing area.

A specific example made of such a material is a pitch-based carbon fiber made of a petroleum pitch or a coal pitch and manufactured by firing the pitch at a high temperature. More specifically, an example of such a needle-shaped pitch-based carbon fiber has a diameter D (average diameter) within the range of 5 μm to 11 μm and a length L (average length) within the range of 50 μm to 1000 μm. Such a needle-shaped pitch-based carbon fiber is easily available in the industrial field.

Preferably, the content of the needle-shaped filler in the elastic layer falls within the range of 5 vol % to 40 vol %.

According to the study of the inventors, the viscosity of the emulsion depends on the formulation of needle-shaped filler with respect to water. Specifically, the viscosity of an emulsion can be changed in accordance with the formulation of needle-shaped fillers.

(3-1-4) Emulsifier

The emulsion can be prepared by mixing an emulsifier D into a mixture liquid in which the A liquid, the B liquid, and the C liquid are mixed at a desired ratio. Examples usable as the emulsifier D include various types. At least one of anionic, cationic, zwitterionic, and nonionic surfactants is usable. Among these types, a nonionic surfactant is particularly favorably usable since it negligibly affects a hydrosilylation catalyst. Preferably, the hydrophile-lipophile balance (HLB) value of the emulsifier is 1.5 or higher but lower than 6.0. The formulation in the emulsifier is preferably 0.2 to 3 parts by mass with respect to 100 parts by mass of the C liquid. After the A liquid, the B liquid, and the C liquid are mixed together, the emulsifier D may be added to the mixture. Alternatively, the emulsifier D may be added to at least one of the A liquid, the B liquid, and the C liquid and then the A liquid, the B liquid, and the C liquid may be mixed together.

(3-1-5) Viscosity of Emulsion

The emulsion is a highly viscous liquid in which water and needle-shaped fillers are emulsified and dispersed in the silicone rubber component. The viscosity of the emulsion depends on the emulsified state of added water or the formulation of needle-shaped fillers rather than the viscosity of the base rubber. The emulsion exhibits non-Newtonian fluid characteristics, that is, the viscosity of the emulsion varies depending on the shear rate. For example, at the temperature of 25° C., the viscosity of the emulsion is 30 to 150 [Pa·s] under the shear rate of 10 [1/s] and 20 to 100 [Pa·s] under the shear rate of 20 [1/s].

(3-2) Molding Method

Figure 5:
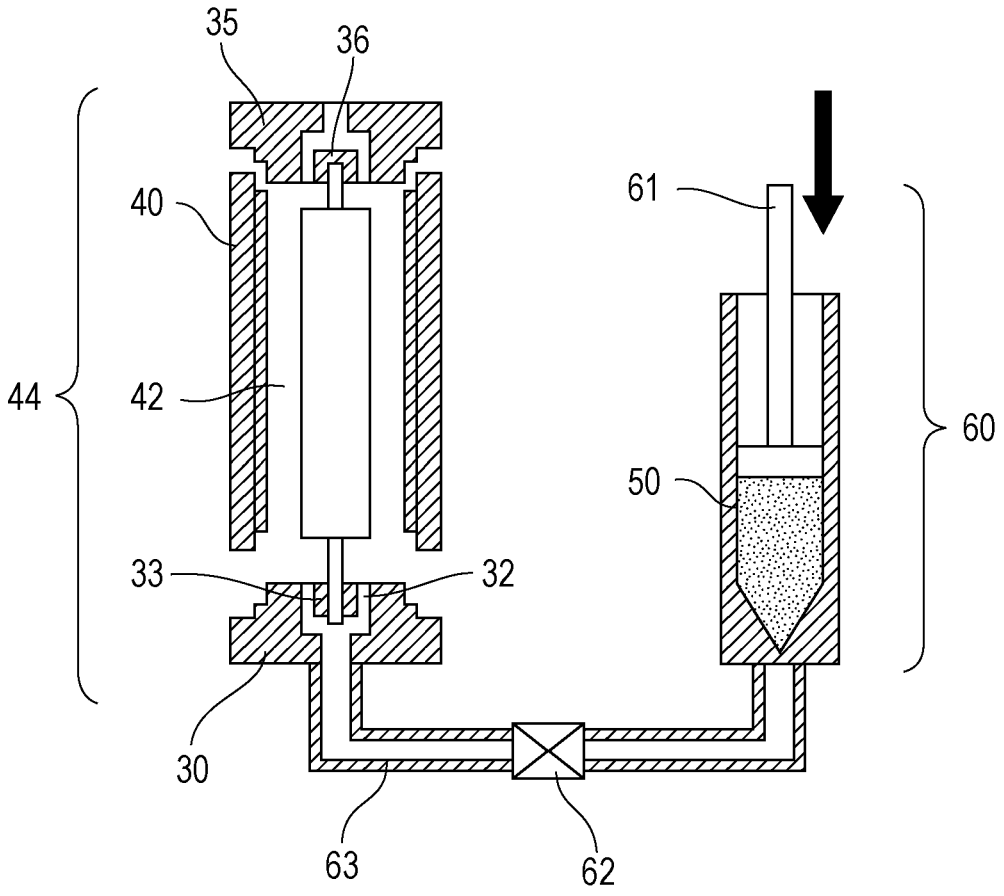
FIG. 5 is a schematic view illustrating a molding method.
Figure 6:
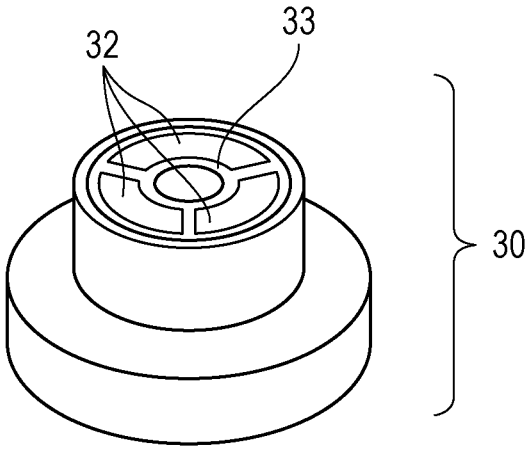
FIG. 6 is a perspective view of an example of a nozzle.
Figure 7:
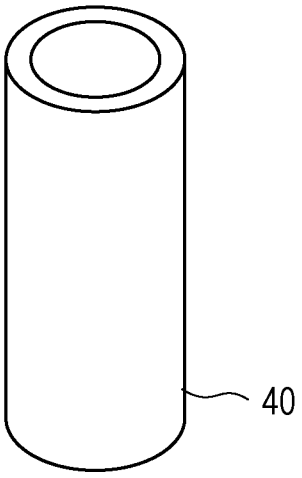
FIG. 7 is a schematic view of an example of a cylindrical mold.

Referring now to FIG. 5 to FIG. 7, the molding method is described. Firstly, a mold for forming a cavity is described.

(3-2-1) Cylindrical Mold

FIG. 7 is a schematic view of a cylindrical mold 40. The cylindrical mold 40 is made of a thick stainless-steel piece, for allowing for the tolerance of the outer diameter of a product, deformation that can occur during molding, and deformation that can occur due to heating. For example, when an elastic roller having an outer diameter of 30 mm is to be manufactured, a favorable example of the mold 40 is a pipe having an outer diameter of 40 mm, an inner diameter of approximately 30 mm although appropriately determined in accordance with the degree of contraction or extension of a used material during the procedure, and a length of 370 mm.

When the above-described mandrel is enclosed in this cylindrical mold, the width of the space (cavity) formed in the mold substantially corresponds to the thickness of the elastic layer of an elastic roller.

(3-2-2) Nozzle

A component having a function of injecting a jet of liquid material into a mold is generally referred to as a nozzle. FIG. 5 is a schematic view of a mold and a material injecting device and schematically illustrates the function of a nozzle 30. The nozzle 30 includes material outlets (gates) 32, from which a material spurts out, and a mandrel fastening portion 33 that holds the rotation shaft of the mandrel 21. The nozzle 30 also has a function of coaxially arranging the mandrel 21 and the cylindrical mold 40 by being fitted to the cylindrical mold 40 together with a cap 35, described below.

The shapes of the gates and the mandrel fastening portion are appropriately designed in accordance with the shapes of the cylindrical mold and the mandrel. The gates 32 may have a structure that allows the emulsion to be smoothly inserted into a cavity 42 defined by the mandrel 21 and the mold 40. The gates 32 are integrated with an adapter connectable to a pipe and inject the emulsion from a material injector including a weighing machine. During injection of the emulsion, the gates having openings wide in the rotation axial direction of the mandrel with respect to the width of the cavity 42 is used. Thus, the emulsion injected through the openings dashes against the bottom surface of the elastic-layer receiving portion 23 of the mandrel 21 so that the flow of the emulsion is disturbed, whereby an elastic layer containing needle-shaped fillers oriented in the thickness direction can be efficiently obtained.

FIG. 6 illustrates an example of the nozzle 30. In FIG. 6, the gates 32 are multiple openings obtained by dividing the circumference of the cavity 42 defined by the mandrel and the cylindrical mold. The reason why the gates 32 are formed in multiple openings is to integrate the gates 32 with the mandrel fastening portion 33 that holds the mandrel. The width of each opening, or each gate 32, is appropriately selectable in accordance with the width of the cavity 42. For example, when the cavity has a width of 3 mm, the selectable opening width falls within the range of 2 mm to 6 mm. The circumferential length of each opening or each gate 32 falls within the range of, for example, 20 mm to 27 mm.

(3-2-3) Cap

The cap 35 is fitted and connected to the end of the cylindrical mold 40 to which the nozzle 30 is not fitted. The cap 35 has an outlet through which air inside the cavity goes out during injection of the material. The cap 35 also includes a mandrel fastening portion 36 that holds the rotation shaft of the mandrel 21. The cap also has a function of coaxially arranging the mandrel 21 and the mold 40 in cooperation with the nozzle 30.

(3-2-4) Molding Method

The cavity 42 is defined by combining the mandrel 21, the cylindrical mold 40, the nozzle 30, and the cap 35. In order to prevent misalignment during molding process, the nozzle 30 and the cap 35 fitted to the cylindrical mold 40 can be formed in the form of an integrated mold 44 after being assembled together using adaptor components or fixing components, not illustrated.

As illustrated in FIG. 5, a pipe 63 serving as an emulsion supply channel has one end connected to the nozzle 30 via adaptor components, not illustrated, and the other end connected to a weighing machine 60 via a valve 62. When a push handle 61 of the weighing machine 60 is pushed down, an emulsion 50 inserted into the weighing machine 60 is transported through the pipe 63 and then from the nozzle 30 to the cavity 42. After the cavity 42 is filled with the emulsion 50, the mold 44 is detached from the pipe 63 and sealed off.

Subsequently, the mold 44 filled with the emulsion is heated using a heating unit such as a furnace or a heating platen at a temperature at which water does not evaporate to advance a cross-linking reaction of the silicone rubber component in the emulsion. Thus, the emulsion in the mold 44 is integrated with the mandrel, whereby a molded silicone-rubber member containing needle-shaped fillers and water can be obtained. Finally, the molded silicone-rubber member is removed from the mold and then heated at a high temperature for dehydration, so that an elastic roller having an elastic layer containing the needle-shaped filler and the void is obtained.

The releasing layer may be formed as a coating on the obtained elastic roller or may be formed in advance on the inner wall surface of the cylindrical mold in a well-known method.

(3-3) Orientation of Needle-Shaped Filler

Generally, a fluid flows through a pipe at different flow rates between a region of the pipe adjacent to the inner wall of the pipe and the center region of the pipe. Specifically, a fluid flowing near the inner wall of the pipe receives friction from the inner wall and thus flows more slowly than a fluid flowing in the center region of the pipe.

With regard to an embodiment of the invention, the flow rate of the emulsion varies in the thickness direction of the cavity during injection of the emulsion. Specifically, the flow rate of a fluid flowing adjacent to the surface of the mandrel or adjacent to the inner wall of the mold is slower than the flow rate of a fluid flowing in the center region due to the friction between the emulsion and the mandrel surface or the mold inner wall. Thus, it is conceivable that the needle-shaped filler be more likely to be oriented in the direction of the flow of the emulsion as a result of receiving a shearing stress in the direction of the flow of the emulsion in regions adjacent to the mandrel and adjacent to the mold inner wall, in which the fluid flows more slowly.

The range of the region adjacent to the mold inner wall in the thickness direction of the cavity, in which the needle-shaped filler are easily oriented, varies depending on the average flow rate of the emulsion that flows through the cavity, the average flow rate being determined by the injection rate (volume) of the emulsion per unit time and an area of cross section of the cavity in the direction perpendicular to the mandrel.

In the case where the average flow rate is slow, the difference in flow rate of the emulsion in the thickness direction of the cavity is relatively small. Thus, the shearing stress that causes the needle-shaped fillers to be oriented in the axial direction mainly affects needle-shaped fillers in an immediate vicinity of the mold inner wall. Thus, the orientation degree of the needle-shaped filler in the first area tends to be low. On the other hand, in the case where the average flow rate is fast, the flow rate of the emulsion varies to a large extent in the width direction of the cavity. Thus, the shearing stress that causes the needle-shaped fillers to be oriented in the axial direction is more likely to affect also needle-shaped fillers in a fluid flowing at a portion away from the mold inner wall. Thus, the orientation degree of the needle-shaped filler in the second area tends to be high.

The average flow rate may be appropriately controlled, with such tendencies taken into account, so that the orientation degree of the needle-shaped filler in the second area be regulated so as not to exceed 50% and so that the orientation degree of the needle-shaped filler in the second area be regulated so as to fall below the orientation degree of the needle-shaped filler in the first area. In the case, for example, where a silicone rubber emulsion containing water and needle-shaped fillers having an aspect ratio of approximately 28 is injected into a cavity having a thickness within the range of 2 to 5 mm to form an elastic layer, the emulsion can be injected so that the average flow rate inside the cavity falls within the range of 4.0 to 8.1 [mm/sec]. In the case where the emulsion is injected into the cavity so that the emulsion flows at the above-described average flow rate, the orientation degree of the needle-shaped filler in the first area of the obtained elastic layer can fall within the range of 59 to 65%. Moreover, the orientation degree of the needle-shaped filler in the second area of the obtained elastic layer can fall within the range of 41 to 50%.

An aspect of the invention attains an elastic roller that can keep its shape stable for a long period of time while preventing temperature rise in a non-sheet-passing area and maintaining quick start-up. In addition, another aspect of the invention attains a fixing device that can efficiently heat a recording medium while minimizing temperature rise in a non-sheet-passing area and that can stably form high-quality images.

EXAMPLES

The following describes examples and comparative examples. Examples according to the invention are specifically described.

Cylindrical Mold

A stainless steel piece was processed into the shape illustrated in FIG. 7 to serve as a cylindrical mold having an inner diameter of 30 mm.

Mandrel

A free-cutting steel (SUM) piece was processed into the shape illustrated in FIG. 8 and prepared as a mandrel including an elastic-layer receiving portion whose outer diameter is 22 mm so as to form a cavity having a thickness of, for example, 4 mm in Example 1.

Mandrels including elastic-layer receiving portions having different outer diameters were prepared in accordance with the thicknesses of elastic layers of examples and comparative examples described below. The outer surfaces of the mandrels were subjected to electroless nickel plating (thickness of 3 to 6 μm) and then subjected to appropriate well-known surface processing so that elastic layers can favorably adhere to the outer surface of any mandrel.

Needle-Shaped Filler

The following pitch-based carbon fiber was used as a needle-shaped filler:

trade name of XN-100-25M (Manufactured by Nippon Graphite Fiber Corporation), average fiber diameter of 9 μm, average fiber length L of 250 μm, and thermal conductivity of 900 W/(m·K).

The above-described needle-shaped filler is described as "100-25M", below.

Preparation of Uncrosslinked Silicone Rubber Emulsion

To prepare a C liquid, 99 parts by mass of deionized water was poured into 1 part by mass of an inorganic thickener (BEN-GEL W-200U), and the mixture was fully stirred to prepare a gel liquid material in advance.

As an emulsifier, a nonionic surfactant (corbitan-fatty acid ester, trade name of IONET HLB4.3, manufactured by Sanyo Chemical Industries, Ltd.) was prepared.

On the other hand, an A liquid and a B liquid of liquid silicone rubber (trade name of DY35-561, manufactured by Dow Corning Toray Co., Ltd.) were respectively used as the A liquid and the B liquid. These liquids were mixed with the needle-shaped filler 100-25M and the mixture was poured into a planetary mixer in the formulation (parts by mass) illustrated in Table 1 to mix the entire mixture. After mixing the mixture to some extent, the C liquid and an emulsifier were poured into the mixer in the formulations illustrated in Table 1 and the resultant mixture was fully stirred, so that emulsions (1) and (2) containing the needle-shaped filler was obtained.

The viscosity of each obtained emulsion was obtained from a flow curve at the shear rate from 0 to 20 $S^{-1}$ and at the temperature 25° C. using a rotational viscosity measuring device (trade name of Roto Visco 1, manufactured by Thermo Fisher Scientific K.K.). The viscosity at the shear rate of 10 $s^{-1}$ was obtained from a rising curve and a falling curve of the obtained flow curve, and the averages of the viscosity were calculated. The measurement was performed three times, and the arithmetic mean of the averages was determined as the viscosity of the emulsion. Table 1 shows the results of measurement.

TABLE 1

| | | Emulsion No. | |
|---|---|---|---|
| | | (1) | (2) |
| Formulation (unit: parts by mass) | A liquid | 45 | 47.5 |
| | B liquid | 45 | 47.5 |
| | C liquid | 90 | 95 |
| | Needle-shaped filler | 44 | 22 |
| | Emulsifier | 0.7 | 0.7 |
| Volume of emulsion [$cm^3$] | | 200 | 200 |
| Specific gravity of emulsion [$g/cm^3$] | | 1.12 | 1.06 |
| Viscosity of emulsion [Pa · s] (at shear rate of 10 [1/s]) | | 100 | 35 |

Releasing Layer

A PFA tube (manufactured by GUNZE Limited) having a thickness of 50 μm was prepared.

Example 1

(1-1)

The PFA tube was fixed in the cylindrical mold by a well-known method in the extended state. The PFA tube and the cylindrical mold were visually confirmed as being closely attached to each other.

(1-2)

A primer (trade name of DY39-067, manufactured by Dow Corning Toray Co., Ltd.) was applied to the inner surface of the PFA tube described in (1-1) by a well-known method and left as it is at the room temperature for a predetermined period of time so as to be dried.

(1-3)

A primer (trade name of DY35-051, manufactured by Dow Corning Toray Co., Ltd.) was applied to the mandrel by a well-known method, fired for a predetermined period of time at 200° C., and then left so as to be cooled.

(1-4)

The nozzle was attached to the pipe of the device illustrated in FIG. 4 using an adaptor and the mandrel described in (1-3) was perpendicularly fixed to the mandrel fastening portion of the nozzle. The cylindrical mold to which the PFA tube described in (1-2) is fixed was installed so that the mandrel is encased in the mold. A cap and an adaptor were fitted to the other end of the mold. The adaptors on both ends were fixed by a fixing member, so that a cavity having a thickness of 4.0 mm and accurately arranged so as to be coaxial with the mandrel in the above described manner was formed.

(1-5)

The emulsion (1) illustrated in Table 1 was injected 100 g per minute by the material injector through the pipe to the cylindrical mold in the manner as described in (1-4) from the lower end of the cylindrical mold fixed. After the injection, the nozzle was detached from the pipe and the adaptors on both ends were sealed off, whereby a mold having an emulsion tightly filled in the cavity was complete.

(1-6)

The mold manufactured in the manner as described in (1-5) was inserted in a furnace set at a temperature of 90° C. and heated for 60 minutes.

(1-7)

The mold was removed from the furnace and cooled to the normal temperature. Subsequently, the molded silicone-rubber member integrated with the mandrel was removed from the mold.

(1-8)

The molded silicone-rubber member integrated with the mandrel was heated for four hours in a furnace set at a temperature of 130° C., so that water was removed from the cured compact. Subsequently, the compact was heated for four hours in the furnace set at the temperature of 200° C., so that the compact was completely cured. After the cooling, the outer diameter of the compact was adjusted using a cutter as needed, whereby the elastic roller was complete.

Example 2 to Example 8

Elastic rollers were obtained in the same manner as described in Example 1, except that the mandrel, the type of emulsion, and the injection rate of the emulsion were appropriately selected and the emulsion was injected while the thickness of the cavity, the average flow rate of the emulsion, and the viscosity of the emulsion were changed in accordance with the conditions described in Table 2.

The average flow rate (mm/s) was calculated by the following formula (2):

$$\text{average flow rate (mm/s)} = \text{injection volume of liquid compound into cavity per minute (mm}^3\text{/s)/area of cross section of cavity (mm}^2\text{)} \quad \text{Formula (2).}$$

Elastic rollers were obtained in the same manner as described in Example 1, except that the mold, the mandrel, the type of emulsion, and the injection rate of the emulsion were appropriately selected and the emulsion was injected while the thickness of the cavity, the injection rate, and the viscosity of the emulsion were changed in accordance with the conditions described in Table 2.

TABLE 2

| | Example | | | | | | | | Comparative Example | |
|---|---|---|---|---|---|---|---|---|---|---|
| | 1 | 2 | 3 | 4 | 5 | 6 | 7 | 8 | 1 | 2 |
| Injection rate of emulsion into cavity [g/min] | 100 | 50 | 100 | 50 | 150 | 75 | 150 | 75 | 200 | 25 |
| Cavity thickness [mm] | 4.00 | 2.75 | 3.50 | 2.00 | 5.00 | 2.75 | 3.50 | 2.25 | 4.00 | 2.25 |
| Emulsion No. | (1) | (1) | (1) | (1) | (2) | (2) | (2) | (2) | (1) | (2) |
| Average flow rate [mm/s] | 4.6 | 3.2 | 5.1 | 4.2 | 6.0 | 5.0 | 8.1 | 6.0 | 9.1 | 2.0 |

Comparative Example 1

Except that the injection rate was changed to 200 g/min, an elastic roller was obtained in the same manner as in the case of Example 1.

Comparative Example 2

Except that the injection rate was changed to 25 g/min, an elastic roller was obtained in the same manner as in the case of Example 8.

Evaluation of Elastic Rollers

Fabricated elastic rollers were evaluated in terms of the following points. The evaluation results are collectively shown in Table 3.

Orientation Degree

The orientation degree of the needle-shaped filler in the elastic layer of each elastic roller was calculated in accordance with the definition of the above-described orientation degree.

Temperature Rise in Non-Sheet-Passing Area

Each elastic roller was installed as a pressing roller in a printer (trade name of LBP-5910, manufactured by CANON KABUSHIKI KAISHA) including a film-heating-type fixing device illustrated in FIG. 1 and the temperature of the non-sheet-passing area of the pressing roller was evaluated.

The circumferential rate of the pressing roller installed in the fixing device was adjusted to 234 mm/sec and the temperature of the heater was set at 220° C. A letter (LTR) size sheet (75 g/m$^2$) was used as a recording medium P that carries toner T and passed through the nip portion N of the fixing device. After 500 sheets having this size were successively passed through the nip portion N in such a manner that the longitudinal direction of the sheets is parallel to the longitudinal direction of the pressing roller, the temperature of the surface of the film 13 in the sheet passing area W (area with which the LTR size sheets do not come into contact) was measured. Here, having an effect on preventing temperature rise in the non-sheet-passing area means that the temperature is kept lower than the temperature (approximately 270° C.) that the non-sheet-passing area of a heating member of a fixing device including a pressing roller having a typical elastic layer has when such a fixing device is used.

Start-Up

In the idling state of the fixing device in which no sheet is passed therethrough, the time from when the heater is switched on to when the temperature of the surface of the film 13 arrives at 180° C. was measured.

Amount of Change in Thickness of Elastic Layer

The fixing device was subjected to an endurance test against idling running of total 300 hours. The thickness of the elastic layer was measured before and after the endurance test. The thickness of the elastic layer was measured in the following manner. From each of the elastic rollers according to Examples and Comparative Examples, a sample was cut out before and after the endurance test in the same manner as illustrated in FIG. 4A. The β cross section was observed at any five points using an optical microscope (trade name of VHX-200, manufactured by KEYENCE Corporation) at a magnifying power of 50 and the thicknesses at five points were averaged. The average was defined as the thickness of the elastic layer.

TABLE 3

| | Elastic layer thickness [mm] | Average flow rate [mm/s] | Porosity [vol %] | Orientation degree in area A | Orientation degree in area B | Non-sheet-passing area temperature | Start-up period [s] | Thickness change amount [mm] |
|---|---|---|---|---|---|---|---|---|
| Example 1 | 4.00 | 4.6 | 45 | 41% | 59% | 205° C. | 10.0 | 0.15 |
| Example 2 | 2.75 | 3.2 | 45 | 42% | 60% | 203° C. | 9.9 | 0.12 |
| Example 3 | 3.50 | 5.1 | 45 | 45% | 64% | 197° C. | 9.7 | 0.14 |
| Example 4 | 2.00 | 4.2 | 45 | 46% | 66% | 197° C. | 9.7 | 0.10 |
| Example 5 | 5.00 | 6.0 | 47 | 48% | 59% | 205° C. | 10.0 | 0.20 |
| Example 6 | 2.75 | 5.0 | 47 | 45% | 60% | 202° C. | 9.9 | 0.16 |
| Example 7 | 3.50 | 8.1 | 47 | 50% | 63% | 200° C. | 9.7 | 0.18 |
| Example 8 | 2.25 | 6.0 | 47 | 46% | 65% | 197° C. | 9.7 | 0.15 |
| Comparative example 1 | 4.00 | 9.1 | 45 | 65% | 69% | 190° C. | 9.5 | 0.50 |
| Comparative example 2 | 2.25 | 2.0 | 47 | 35% | 35% | 210° C. | 11.1 | 0.15 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-145828 filed Jul. 16, 2014 and No. 2014-147000 filed Jul. 17, 2014, which are hereby incorporated by reference herein in their entirety.

What is claimed is:

1. An elastic roller comprising:

a mandrel; and an elastic layer provided on the circumferential surface of the mandrel, the elastic layer containing a needle-shaped filler and a shell-less void and having a porosity of 20 vol % or more and 60 vol % or less, the elastic layer containing a first area and a second area, the first area extending from a surface of the elastic layer opposite to a surface facing the mandrel toward the mandrel and having a thickness of 30% of the thickness of the elastic layer, the second area being a central area in a thickness direction of the elastic layer and having a thickness of 40% of the thickness of the elastic layer, wherein, an orientation degree of the needle-shaped filler in the second area is 50% or lower, and an orientation degree of the needle-shaped filler in the first area is higher than that in the second area, where, the orientation degree is a percentage ratio of the number of the needle-shaped filler in the longitudinal direction of the elastic layer to the number of total observable needle-shaped filler.

2. The elastic roller according to claim 1, wherein the elastic layer is a silicone rubber layer.

3. The elastic roller according to claim 2, wherein the elastic layer is a sole silicone rubber layer in the elastic roller.

4. The elastic roller according to claim 1, wherein, in a sheet passing area of the elastic roller, the needle-shaped filler in the second area have an orientation degree of 50% or lower, and wherein, in the sheet passing area of the elastic roller, the needle-shaped filler in the first area has an orientation degree higher than that of the needle-shaped filler in the second area.

5. The elastic roller according to claim 1, wherein the needle-shaped filler in the first area has an orientation degree of 55% or higher.

6. The elastic roller according to claim 1, wherein the elastic layer has a porosity of 40 vol % or more and 60 vol % or less.

7. The elastic roller according to claim 1, wherein the needle-shaped filler is a pitch-based carbon fiber.

8. The elastic roller according to claim 1, wherein the needle-shaped filler has a diameter of 5 μm or more and 11 μm or less and a length of 50 μm or more and 1000 μm or less.

9. The elastic roller according to claim 1, wherein the elastic layer has a thickness of 2 mm or more and 5 mm or less.

10. An elastic roller comprising:

a mandrel; and an elastic layer provided on the circumferential surface of the mandrel, the elastic layer containing a needle-shaped filler and a void and having a porosity of 20 vol % or more and 60 vol % or less, the elastic layer containing a first area and a second area, the first area extending from a surface of the elastic layer opposite to a surface facing the mandrel toward the mandrel and having a thickness of 30% of the thickness of the elastic layer, the second area being a central area in a thickness direction of the elastic layer and having a thickness of 40% of the thickness of the elastic layer, wherein, an orientation degree of the needle-shaped filler in the second area is 50% or lower, and an orientation degree of the needle-shaped filler in the first area is 55% or higher, where the orientation degree is a percentage ratio of the number of the needle-shaped filler in the longitudinal direction of the elastic layer to the number of total observable needle-shaped filler.

11. The elastic roller according to claim 10, wherein the elastic layer is a silicone rubber layer.

12. The elastic roller according to claim 11, wherein the elastic layer is a sole silicone rubber layer in the elastic roller.

13. The elastic roller according to claim 10, wherein, in a sheet passing area of the elastic roller, the orientation degree of the needle-shaped filler in the second area is 50% or lower, and wherein, in the sheet passing area of the elastic roller, the orientation degree of the needle-shaped filler in the first area is higher than that in the second area.

14. The elastic roller according to claim 10, wherein the elastic layer has a porosity of 40 vol % or more and 60 vol % or less.

15. The elastic roller according to claim 10, wherein the needle-shaped filler is a pitch-based carbon fiber.

16. The elastic roller according to claim 10, wherein the needle-shaped filler has a diameter of 5 μm or more and 11 μm or less and a length of 50 μm or more and 1000 μm or less.

17. The elastic roller according to claim 10, wherein the elastic layer has a thickness of 2 mm or more and 5 mm or less.

18. A fixing device, comprising:

a heating member; and a pressing member disposed opposite the heating member and pressed against the heating member, wherein a recording medium is inserted into a nip portion between the heating member and the pressing member and tightly held at and transported through the nip portion so as to be heated, and wherein the pressing member is an elastic roller, and wherein the elastic roller comprising:

a mandrel; and an elastic layer provided on the circumferential surface of the mandrel, the elastic layer containing a needle-shaped filler and a shell-less void and having a porosity of 20 vol % or more and 60 vol % or less, the elastic layer containing a first area and a second area, the first area extending from a surface of the elastic layer opposite to a surface facing the mandrel toward the mandrel and having a thickness of 30% of the thickness of the elastic layer, the second area being a central area in a thickness direction of the elastic layer and having a thickness of 40% of the thickness of the elastic layer, wherein, an orientation degree of the needle-shaped filler in the second area is 50% or lower, and an orientation degree of the needle-shaped filler in the first area is higher than that in the second area, where, the orientation degree is a percentage ratio of the number of the needle-shaped filler in the longitudinal direction of the elastic layer to the number of total observable needle-shaped filler.

* * * * *